US011622631B1

(12) United States Patent
Berkowitz

(10) Patent No.: US 11,622,631 B1
(45) Date of Patent: Apr. 11, 2023

(54) APPARATUS AND METHOD FOR ASSEMBLING A MODULAR ERGONOMIC CHAIR WITHOUT USING FASTENERS

(71) Applicant: Jay A. Berkowitz, Penn Valley, PA (US)

(72) Inventor: Jay A. Berkowitz, Penn Valley, PA (US)

( * ) Notice: Subject to any disclaimer, the term of this patent is extended or adjusted under 35 U.S.C. 154(b) by 0 days.

(21) Appl. No.: 17/945,526

(22) Filed: Sep. 15, 2022

(51) Int. Cl.
*A47C 7/54* (2006.01)
*A47C 4/02* (2006.01)
*A47C 7/00* (2006.01)

(52) U.S. Cl.
CPC ..... *A47C 7/004* (2013.01); *A47C 4/02* (2013.01); *A47C 7/546* (2013.01)

(58) Field of Classification Search
CPC ..... A47C 4/02; A47C 7/004; A47C 7/546
USPC ..... 297/411.26, 411.27, 440.1, 440.14, 297/440.15, 440.16
See application file for complete search history.

(56) References Cited

U.S. PATENT DOCUMENTS 4,216,995 A * 8/1980 Inaba ..... A47C 4/02 297/440.22
4,760,802 A * 8/1988 Leong ..... A47C 9/10 108/150
5,368,364 A * 11/1994 Kanai ..... A47C 7/546 297/440.1 X
5,419,617 A * 5/1995 Schultz ..... A47C 7/546 297/440.1 X
5,839,784 A * 11/1998 Breen ..... A47C 1/0307 297/411.35 X
5,944,387 A * 8/1999 Stumpf ..... A47C 1/03 297/411.26 X
6,296,313 B1 * 10/2001 Wu ..... A47C 1/0307 297/411.36

(Continued)

FOREIGN PATENT DOCUMENTS

OA 06308 6/1981
WO WO 07/78185 A2 12/2000

OTHER PUBLICATIONS

"Office and administrative support occupations make up nearly 16 percent of U.S. employment, May 2013", U.S. Bureau of Labor Statistics, Apr. 9, 2014, retrieved from https://www.bls.gov/opub/ted/2014/ted_20140409.htm on Sep. 15, 2022.

*Primary Examiner* — Rodney B White

(57) ABSTRACT

An apparatus/method for assembling a modular ergonomic chair without using fasteners including a seat support structure that includes a plurality of recesses, wherein each recess includes a releasable latch mechanism (RLM); a vertical seat shaft; a pedestal; a first and second arm rest each of which include an arm rest connecting member, wherein the arm rest connecting member has a cavity to receive a RLM latch member of the seat support structure; and a back support, which includes a connecting member, wherein the connecting member also has a cavity to receive the latch member of another RLM of the seat support structure. The back support, first arm rest, and second arm rest are removably coupled to the seat support structure to permit easy assembly and interchanging of seat components. A reclining back support embodiment is also provided using a RLM latch spring with a corresponding connecting member in the seat support structure.

11 Claims, 13 Drawing Sheets

(56) References Cited

U.S. PATENT DOCUMENTS 6,409,266 B1* 6/2002 Chen ..... A47C 1/03 297/411.35 X
7,357,453 B2 4/2008 Wu
7,510,243 B1 3/2009 Hung
9,022,480 B2 5/2015 Hazzard et al.
9,084,487 B1* 7/2015 Su ..... A47C 1/03
9,795,220 B1* 10/2017 Chen ..... A47C 1/03
2002/0036422 A1* 3/2002 Prince ..... A47C 1/03 297/411.35
2003/0227208 A1* 12/2003 Burwell ..... A47C 7/70 297/411.2
2006/0261659 A1* 11/2006 Dykes ..... A47C 7/541 297/411.37
2007/0200415 A1* 8/2007 Eberlein ..... A47C 1/03 297/411.37
2010/0038950 A1* 2/2010 Lee ..... A47C 1/0305 297/411.36
2010/0123346 A1* 5/2010 Lin ..... A47C 1/03 297/411.37
2010/0187882 A1* 7/2010 Chen ..... A47C 4/02 297/285
2011/0068613 A1* 3/2011 Breitkreuz ..... A47C 7/42 297/440.15
2011/0140498 A1* 6/2011 Tsai ..... A47C 1/0307 297/411.38
2012/0025574 A1* 2/2012 Wilkinson ..... A47C 7/14 297/440.1 X
2014/0239687 A1* 8/2014 Hazzard ..... A47C 4/02 297/440.22
2014/0354026 A1* 12/2014 Gorgi ..... A47C 1/03 297/411.38
2016/0120320 A1* 5/2016 Igarashi ..... A47C 7/14 297/312
2017/0027329 A1* 2/2017 Su ..... A47C 1/0307
2017/0350552 A1* 12/2017 James ..... A47B 13/021
2022/0031073 A1* 2/2022 Kinoshita ..... A47C 1/03272
2022/0034346 A1* 2/2022 Saperton ..... F16B 9/05
2022/0087424 A1* 3/2022 Goetz ..... A47C 7/004

* cited by examiner

APPARATUS AND METHOD FOR ASSEMBLING A MODULAR ERGONOMIC CHAIR WITHOUT USING FASTENERS

BACKGROUND OF THE INVENTION

1. Field of Invention

This invention relates generally to modular furniture, and, more particularly, to an apparatus and method for forming an ergonomic chair with replaceable arm rests and a replaceable back support using releasable latch mechanisms without the need for any fasteners during assembly.

2. Description of Related Art

In 2013, office and administrative support was the largest occupational group in the United States. [1] With the increase in general work force rates and work-from-home rates in 2022, there is an increased need for office seating that is comfortable, supportive, customizable, and easy to assemble.

Prior attempts have been made to create adjustable seating. For example, WO 2007/8185 A2 (Ball et al.) discloses a chair with adjustable back and arm rests. The arm rests in Ball are "slidably supported on the back spine assembly" of the chair. The backrest couples to the chair via a rod and tube mechanism, wherein the rod of the backrest frame. Bolts are utilized to secure the adjustable height of the spine assembly. While the chair disclosed in Ball offers some form of adjustment, the arm rests are not able to be adjusted or interchanged separately from the spine assembly, as the arm rests and back rest are connected. Further, fasteners or rods are still required to assemble the chair, prohibiting easy adjustment or interchanging of parts if desired.

U.S. Pat. No. 7,357,453 B2 (Wu) discloses a chair with separate arm and back rests which couple together via a sliding mechanism. However, the chair disclosed with Wu requires the use of fasteners to couple the arm rests and back rest to the seat support structure, in this case a series of dowels and bolts.

OA 6308 A (GMSA) discloses a modular house chair, wherein the arms and back rest are coupled together separately to the seat support structure. However, the chair disclosed in GMSA does not have optimum adjustability due to its bulkier design and still requires the use of fasteners to couple the components of the chair together.

As shown above, the prior art fails to disclose a modular design that does not use fasteners, such as bolts, rods, dowels, or screws, as these parts can often get lost and prevent the quick interchangeability or adjustability of components of an office chair. Thus, there is a need for office chairs that are easily adjustable and offer the ability to quickly interchange the type of armrest or backrest to fit the user in a modular, snap-in design without the use of fasteners.

All references cited herein are incorporated herein by reference in their entireties.

BRIEF SUMMARY OF THE INVENTION

A modular chair having components that can be assembled without the use of fasteners (e.g., screws, bolts, etc.) is disclosed. The modular chair comprises: a pedestal into which one end of a vertical seat shaft is fitted; a seat support structure, wherein the seat support structure includes a plurality of recesses along its sides and includes a vertical seat shaft receptacle on a bottom side for receiving a second end of the vertical seat shaft, and wherein each recess includes a releasable latch mechanism; a first arm rest and a second arm rest, wherein each arm rest includes an arm rest connecting member having a cavity therein, each cavity receiving therein a latch member of the releasable latch mechanism of a corresponding one of the plurality of recesses when the arm rest connecting member is inserted into the corresponding one of the plurality of recesses; and a back support, wherein the back support includes a back support connecting member also having a cavity therein, wherein the cavity of the back support connecting member receiving therein a latch member of the releasable latch mechanism of another one of the plurality of recesses.

A modular chair having components that can be assembled without the use of fasteners (e.g., screws, bolts, etc.) is disclosed. The modular chair comprises: a pedestal into which one end of a vertical seat shaft is fitted; a seat support structure, wherein the seat support structure includes: a plurality of recesses along its sides and wherein each recess includes a releasable latch mechanism; a seat connecting member projecting from the seat support along a side that does not include a recess, wherein the seat connecting member comprises a cavity therein; a vertical seat shaft receptacle on a bottom side of the seat support for receiving a second end of the vertical seat shaft; a first arm rest and a second arm rest, wherein each arm rest includes an arm rest connecting member having a cavity therein, each cavity receiving therein a latch member of the releasable latch mechanism of a corresponding one of the plurality of recesses when the arm rest connecting member is inserted into the corresponding one of the plurality of recesses; and a reclining back support having a lower portion having a chamber with a latch spring (e.g., a double torsion spring, etc.) positioned therein, the seat connecting member configured for entry into the chamber causing a portion of the latch spring to releasably engage within the cavity of the seat connecting member to connect the reclining back support to the modular chair.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF PREFERRED EMBODIMENTS OF THE INVENTION

Figure 1:
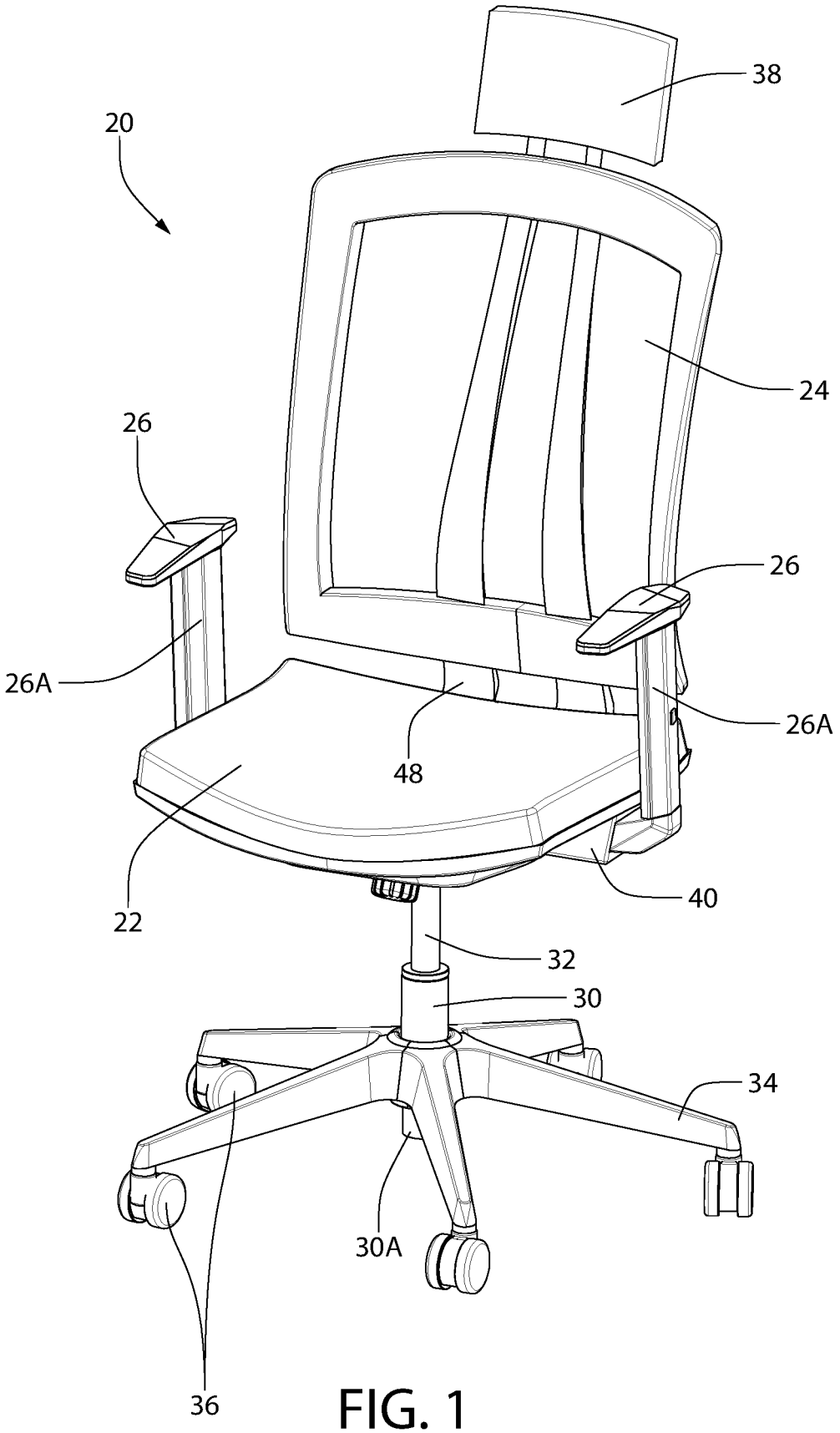
FIG. 1 is an isometric view of an exemplary embodiment of the apparatus of the invention.

The invention will be illustrated in more detail with reference to the following Examples, but it should be understood that the present invention is not deemed to be limited thereto.

The apparatus a seat support structure, wherein the seat support structure includes a plurality of recesses, wherein each recess includes a releasable latch mechanism; a vertical seat shaft; a pedestal; a first arm rest and a second arm rest, wherein each arm rest includes an arm rest connecting member having a cavity therein, each cavity receiving therein said releasable latch mechanism of a corresponding one of said plurality of recesses when said arm rest connecting member is inserted into said corresponding one of said plurality of recesses; a back support, wherein the back support includes a back support connecting member also having a cavity therein, said cavity of said back support connecting member receiving therein said releasable latch mechanism of another one of said plurality of recesses when said back support connecting member is inserted into said another one of said plurality of recesses; and wherein said seat support structure, vertical seat shaft, pedestal, said first and second arm rests and said back support are assembled together to form said modular chair in the absence of using any fasteners.

The modular chair includes a plurality of recesses within the seat support structure. Each recess includes a releasable latch mechanism. The arm rest connecting member to be attached to the seat support structure includes a cavity. When the arm rest connecting member of the arm rest inserts into a recess, the latch member of the releasable latch mechanism of the recess slides into the cavity of the arm rest connecting member, creating a snap-in, interlocking system which couples the arm rest connecting member to the seat support structure without the user of fasteners such as screws, bolts, etc. The same interlocking system is used for other modular pieces, such as coupling a back support to the seat support structure. For example, the back support includes a back support connecting member, wherein the back support connecting member includes a cavity. The back support connecting member is inserted into a recess within the seat support structure, wherein the latch member of the releasable latch mechanism, within the recess, slides into a cavity within the back support connecting member. Once the latch member slides into the cavity, the back support connecting member is secured without the user of fasteners. In certain examples, a head support is coupled to the back support with the same method including the releasable latch mechanism, a head support connecting member including a cavity, and a recess within the back support. The combination of recesses, connecting members such as arm rest connecting members or back support connecting members, releasable latch mechanisms, and cavities permit a user of the modular chair of the invention to interchange various seat components including but not limited to back supports, arm rests, and head supports, without the use of fasteners.

In certain examples, the vertical seat shaft of the apparatus is adjustable in length, permitting a user to adjust the height of the modular chair. On such examples, the seat support structure further includes a lever, wherein the vertical seat shaft can be extended or retracted when the lever is pulled by a user, permitting the user to adjust the height of the vertical seat shaft and modular chair in general. When the user achieves the desired height, the user releases the lever, locking the vertical seat shaft in place and stabilizing the chair for the user to sit on the seat support structure. The height adjustment mechanism is a conventional lift mechanism, e.g., closed system-nitrogen transfer that is controlled by the lever. In certain examples, the vertical seat shaft includes a gas lift cylinder. When the lever is pulled and weight is not present on the seat support structure, the gas volume inside said gas lift cylinder increases and gas pressure decreases, causing the height of the vertical seat shaft to extend and the height of the chair to increase. When the lever is pulled and a user places their weight on the seat support structure, the gas volume inside said gas lift cylinder decreases and the gas pressure increases, causing the height of the vertical seat shaft to retract. When the lever is released, the vertical seat shaft is locked in place. The user can adjust the height of the chair by pulling the lever and adding or releasing their weight to the seat support structure before releasing the lever at the desired height. In certain examples, the vertical seat shaft lowers and is received into a pedestal receptacle when the user decreases the height of the chair.

In further examples, the pedestal includes a plurality of wheels coupled to the distal underside of the pedestal, enabling the user to roll the chair and easily adjust its location while sitting on the chair. When assembling the chair, the user places the distal end of the vertical seat shaft into a pedestal receptacle on the pedestal and places the proximal end of the vertical seat shaft into a seat receptacle on the underside of the seat support structure. The vertical seat shaft securely attaches to the pedestal and the seat support structure without the use of fasteners.

The seat support structure includes a recess having a releasable latch mechanism to receive the back rest connecting member of the back support and enable coupling of the back support to the seat support structure. In certain examples, the back support includes a flexible mesh material. In other examples, the back support includes material including but not limited to nylon, fabric, leather, or a plastic. In further examples, the back support includes padding to further cushion the user's spine. In still further examples, the back support is shaped in an ergonomic design to follow the curvature of the human spine. In certain examples, the user is able to uncouple the back support from the seat support structure, select a second back support, and couple the second back support to the seat support structure. The second back support includes a back support connecting member identical to the first back support, wherein the back support connecting member includes a cavity, and the back support connecting member can be inserted into a recess of the seat support structure, wherein the recess includes a latch member within the recess which seats itself into the cavity of the back support connecting member when the back support connecting member is securely attached. The modular system combined with the snap-in interlocking mechanism of the seat components permit the user to select different back rests that suit the user's needs and easily customize the chair without the user of fasteners and with quick assembly.

In certain examples, the back support is capable of reclining, wherein the user can recline or position the back support in an upright position as they desire. In certain examples, the back support includes a pivot point, wherein the pivot point allows the user to adjust the recline of the back support and lock the back support into place when the desired recline is achieved. In certain examples of the apparatus including the reclining back support, the back support is coupled to a back support connecting member including a right-angled U-shaped recess designed to receive a seat connecting member coupled to the seat support structure. In examples including this attachment mechanism, the right-angled U-shaped recess further includes a latch spring which slides into a cavity of the seat connecting member to secure the reclining back support to the seat support structure.

In further examples, the user may uncouple the first arm rest and second arm rest from the seat support structure, select a new third arm rest and fourth arm rest, and couple the third arm rest and fourth arm rest to the seat support structure. Such coupling and uncoupling is achieved through the releasable latch mechanism and without the use of fasteners. The user is then able to remove arm rests and replace them with different arm rests designed to couple to the seat support structure to customize the user experience, such as choosing armrests with resting platforms that are wider, more cushioned, or have an ergonomic shape. Any arm rest compatible with the seat support structure includes identical arm rest connecting members, wherein any arm rest connecting member includes a cavity. The arm rest connecting member is then inserted into a recess of the seat support structure which causes the latch member to seat itself within the cavity when the arm rest connecting member is securely coupled to the seat support structure.

Referring to the Figures, FIG. 1 is an isometric view of an exemplary embodiment of the apparatus of the invention. The apparatus 20 includes a seat support structure 22. The seat support structure 22 includes a plurality of recesses, including recesses 40 for arm rest connecting members 28 (FIG. 3) and a recess 40A (FIG. 8) for a back support connecting member 48. The arm rest connecting members 28 (FIG. 3) and back support connecting member 48 are inserted into the recesses 40 and 40A (FIG. 3) and secured via a releasable latch mechanism (FIGS. 4A-4C and 11A-11B) without the use of fasteners. Each arm rest connecting member 28 (FIG. 3) is coupled to an arm rest support 26A of an arm rest 26. In the exemplary apparatus 20 shown in FIG. 1, the apparatus includes two arm rests 26. The back support connecting member 48 is coupled to a back support 24 which supports the back of a user when the user is seated on the chair. In this particular example, a head support 38 is also coupled to the back support 24 to provide additional comfort and support to the user's head when sitting in a relaxed position. The apparatus 20 additionally includes a vertical seat shaft 32, which couples to the seat support structure 22 on the vertical seat shaft's proximal end via a seat receptacle 31 (FIG. 8) and a pedestal receptacle 30 on its distal end using a friction fit, with no fasteners being used. In certain examples, the pedestal receptacle 30 extends from above the pedestal 34, wherein the pedestal receptacle 30 receives the vertical seat shaft 32 within its proximal end, through the pedestal 34, using a friction fit, via a pedestal receptacle passage 30A, and below the pedestal 34. The extension of the pedestal receptacle 30 below the pedestal 34 permits the vertical seat shaft 30 to descend downward into the pedestal receptacle 30 in examples where a user desires to decrease the height of the chair. The vertical seat shaft 32 is inserted into the seat receptacle 31 (FIG. 8) and pedestal receptacle 30 without the use of fasteners. In certain examples, a secure fit between the vertical seat shaft 32 and the seat receptacle 31 and pedestal receptacle 30 is achieved through friction, wherein the vertical seat shaft 32 is sized to exactly fit into the seat receptacle 31 and pedestal receptacle 30 with no additional space to permit side-to-side movement. The pedestal receptacle 30 is capable of receiving the vertical seat shaft 32 when a user is decreasing the height of the chair, and in certain examples, the vertical seat shaft extends from the pedestal receptacle when the user is increasing the height of the chair. The pedestal receptacle 30 is part of a pedestal 34, wherein the pedestal 34 provides support and stabilization for the chair when the chair is stationary and when in use. In certain examples, the pedestal 34 further includes wheels 36 to permit the user to move the chair's location while sitting in the chair.

Figure 2:
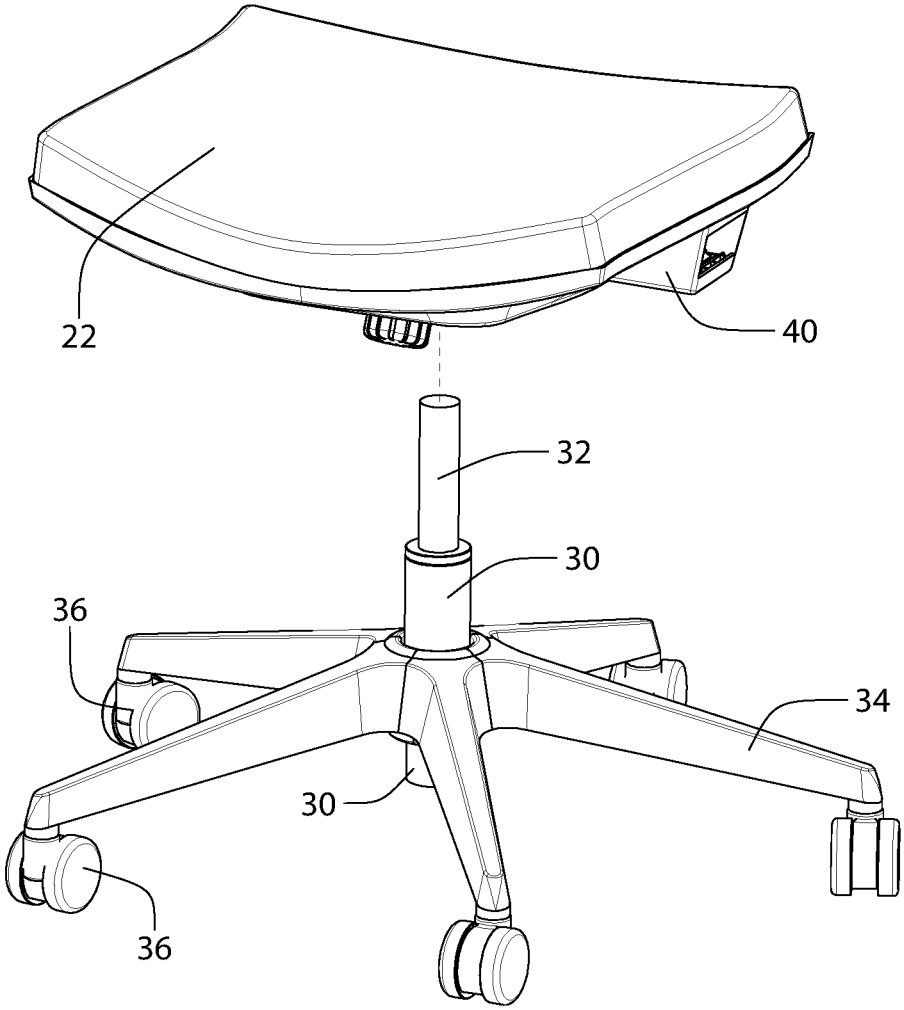
FIG. 2 is an isometric-exploded view showing the coupling of the seat support structure to the vertical seat shaft and pedestal.

FIG. 2 is an isometric semi-exploded view showing the coupling of the seat support structure 22 to the vertical seat shaft 32 and pedestal 34. In this view, the seat support structure 22 is uncoupled from the vertical seat shaft 32. The vertical seat shaft 32 is shown situated within a pedestal receptacle 30, wherein the vertical seat shaft can extend or retract from the receptacle. The pedestal 34 serves to stabilize the bottom of the chair, and in this particular example, the pedestal further includes wheels 36 for enhanced movement in addition to the pedestal receptacle 30. In certain embodiments, the seat support structure 22 further includes a lever 42 (See FIG. 5). When the user activates the lever 42, the user can add weight to the seat support structure 22 to cause the vertical seat shaft to descend into the seat receptacle 30 to decrease the height of the chair, or the user can remove weight from the seat support structure to cause the vertical seat shaft to ascend from the seat receptacle, increasing the height of the chair. The lever 42 activates a lift mechanism 52 (FIG. 10) to enable the vertical seat shaft to ascend and retract into the seat receptacle 30. This particular view of the seat support structure additionally shows one of the recesses 40 which receive the arm rest connecting member 28 (FIG. 3) of the arm rest 26 (FIG. 3).

Figure 3:
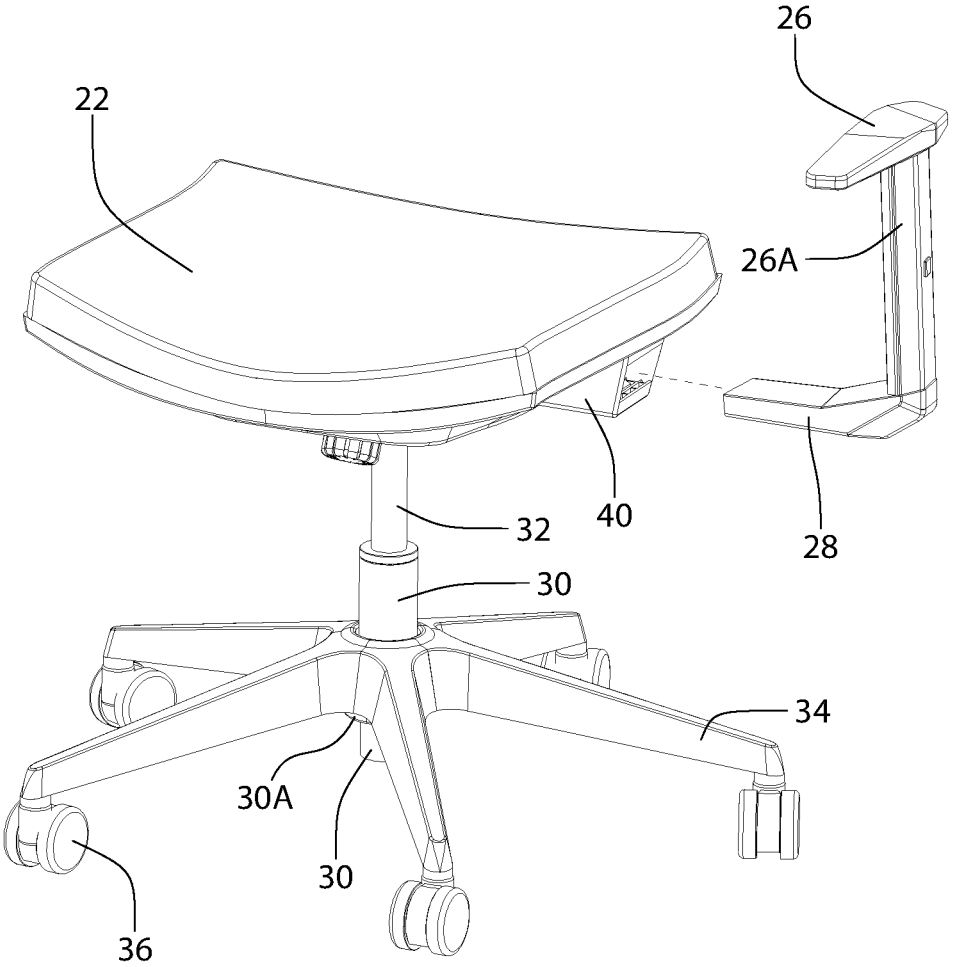
FIG. 3 is an isometric-exploded view showing the coupling of an exemplary arm rest of the invention to the seat support structure.

FIG. 3 shows an isometric exploded view showing the coupling of an exemplary arm rest 26 of the invention to the seat support structure 22. The arm rest 26 includes an arm rest support 26A and an arm rest connecting member 28. The arm rest connecting member 28 further includes a cavity 46 (FIG. 4C). When the arm rest connecting member 28 is inserted into a recess 40 designed to receive it, a releasable latch mechanism 44 within the recess (FIGS. 4A-4C) slides into the cavity 46 (FIG. 4C) within the arm rest connecting member 28, securing the arm rest connecting member 28 into the seat support structure 22 without the use of fasteners. In certain examples, the same releasable latch mechanism is used to attach other components of the modular chair, including but not limited to the back support 24 (FIG. 1). The hollow nature of the pedestal receptacle 30 is shown that receives the vertical seat shaft 32. In this nonlimiting example, the pedestal receptacle 30 extends from above the pedestal 34, through the center of the pedestal 34 via a pedestal receptacle passage 30A, and below the pedestal 34. The pedestal 34 is shown, wherein the pedestal includes wheels 36.

Figure 4A:
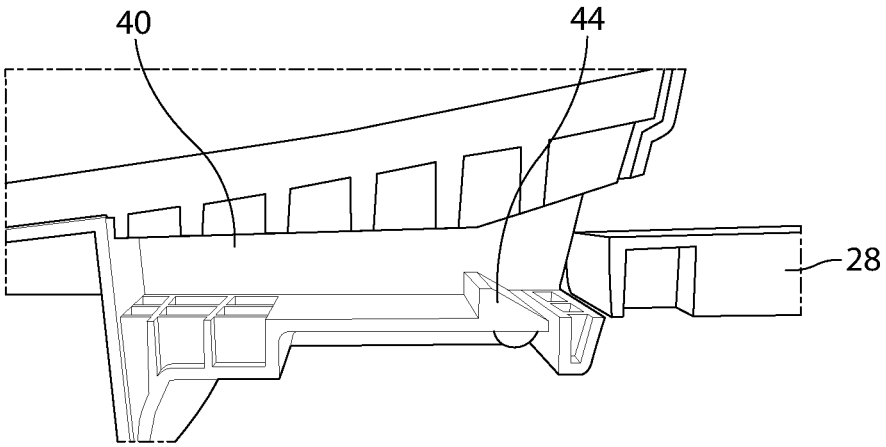
FIG. 4A is a cross-sectional side view of the releasable arm rest latch mechanism of the invention before an arm rest connecting member is inserted into a recess of the seat support structure.

FIG. 4A is a cross-sectional side view of the releasable arm rest latch mechanism of the invention before an arm rest connecting member 28 is inserted into a recess 40 of the seat support structure 22 (FIG. 3). In this view, the end of the arm rest connecting member 28 is visible inserting into a recess 40 within the seat support structure 22 (FIG. 3). The recess 40 further includes a latch member 44 of the releasable latch mechanism within the recess 40.

Figure 4B:
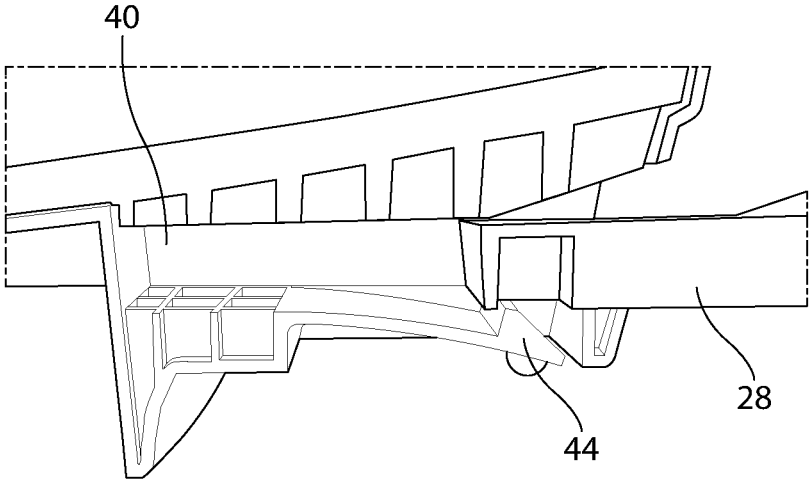
FIG. 4B is a cross-sectional side view of the releasable latch mechanism of the invention showing the initial insertion of the arm rest connecting member into the recess of the seat support structure.
Figure 4C:
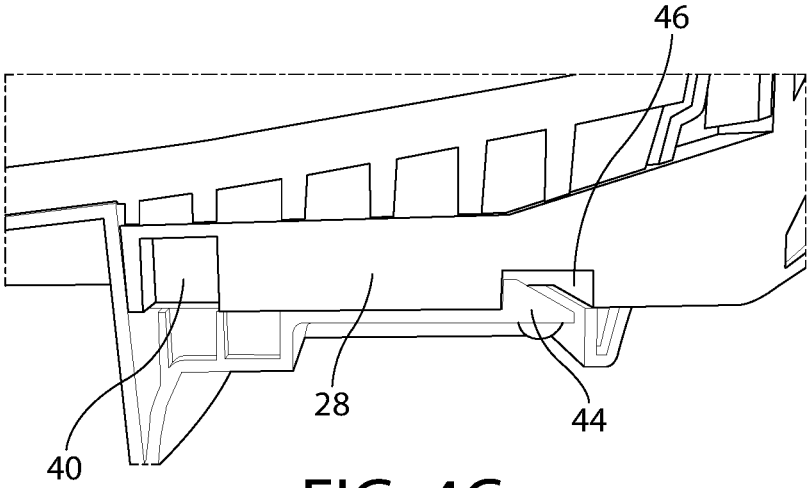
FIG. 4C is a cross-sectional side view of the releasable latch mechanism of the invention showing the arm rest connecting member fully secured into the recess of the seat support structure.

FIG. 4B is a cross-sectional side view of the releasable latch mechanism of the invention showing the initial insertion of the arm rest connecting member 28 into the recess 40 of the seat support structure 22. When the end of the arm rest connecting member 28 is inserted into the recess 40, the latch member 44 within the recess is pressed downward, permitting the arm rest connecting member to enter the recess 40. Notably, the latch member's 44 shape has an inclined surface permitting the arm rest connecting member 28 to glide or ride over it upon insertion into the recess 40.

FIG. 4C is a cross-sectional side view of the latch member 44 of the invention showing the arm rest connecting member 28 fully secured into the recess 40 of the seat support structure 22 (FIG. 3). In this view, the cavity 46 within the arm rest connecting member 28 is shown. Once the arm rest connecting member 28 is fully inserted into the recess 40, the cavity 46 within the arm rest connecting member 28 relieves the pressure on the latch member 44 previously placed on it by the body of the arm rest connecting member 28 pushing it down, and the latch member 44 snaps back into position inside the cavity 46. Because of the latch member's 44 shape, the arm rest connecting member 28 is not able to unintentionally slide out of the recess 40, and the arm rest connecting member is securely coupled within the recess 40 without the use of fasteners. This enables the arm rest 26 (FIG. 3) to be securely coupled to the seat support structure 22 (FIG. 3).

Conversely, if it becomes necessary to replace an arm rest 26, the user can simply apply a downward pressure to the latch member 44 (e.g., using a screwdriver or other slender member tool, etc.) to displace the latch member 44 out of the cavity 46 and thereby releasing the arm rest connecting member 28 and allowing it to be removed from the recess 40.

Figure 5:
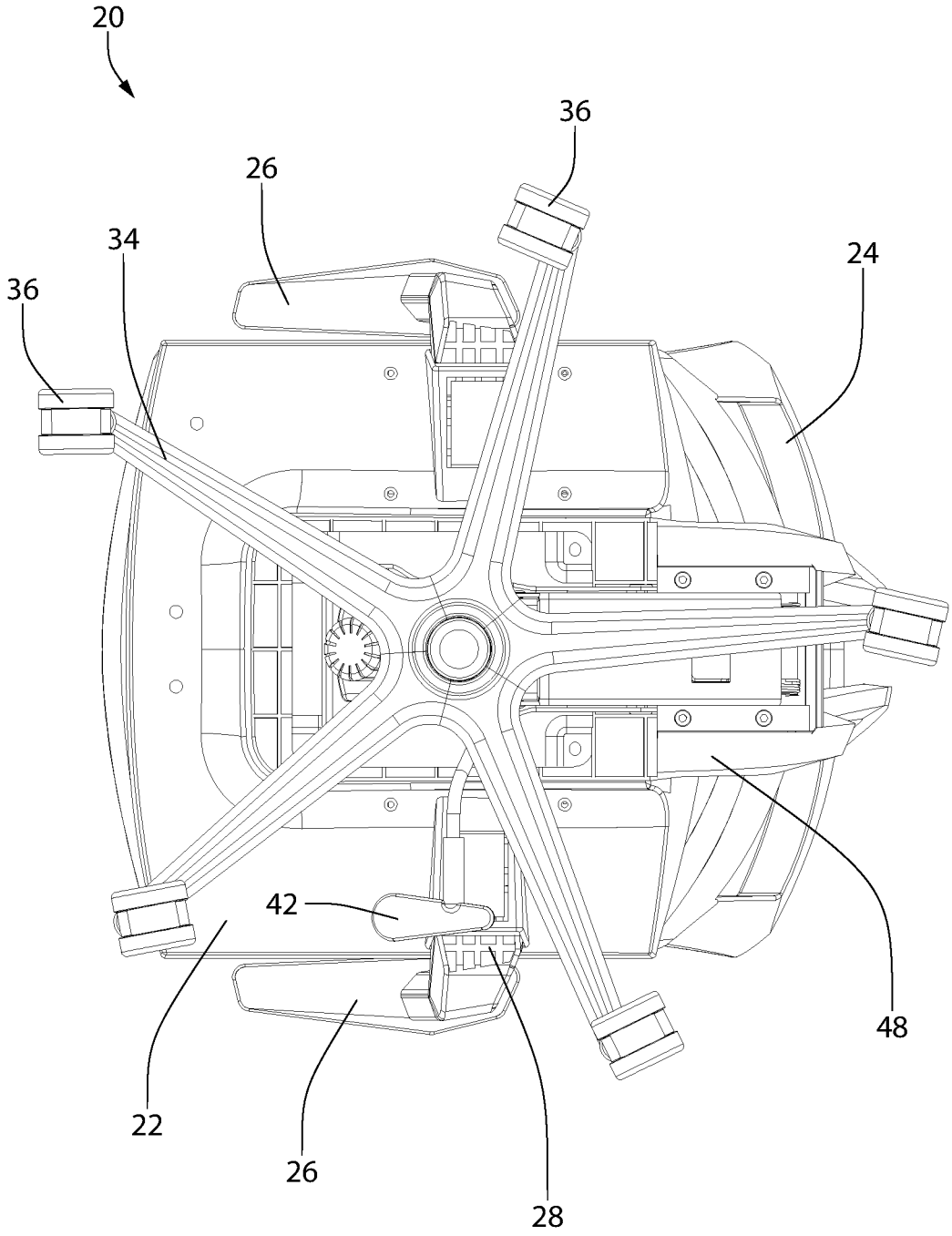
FIG. 5 shows the underside of an exemplary embodiment of the apparatus with the arm rests and back support fully installed.

FIG. 5 shows the underside of an exemplary embodiment of the apparatus 20 with the arm rests 26 and back support 24 fully installed. The portion of the arm rest connecting member 28 of the arm rest 26 that is not inserted into a recess 40 (FIGS. 4A-4C) is visible, and the arm rest 26 is fully coupled to the seat support structure 22. Additionally, the back support 24 and portion of the back support connecting member 48 that is not inserted into a recess 40A (FIG. 8) is visible, and the back support 24 is securely coupled to the seat support structure 22. The underside of the pedestal 34 is shown, and the pedestal includes wheels 36. Further, the lever 42 is visible, wherein the lever is used to assist the user in adjusting the height of the chair.

Figure 6:
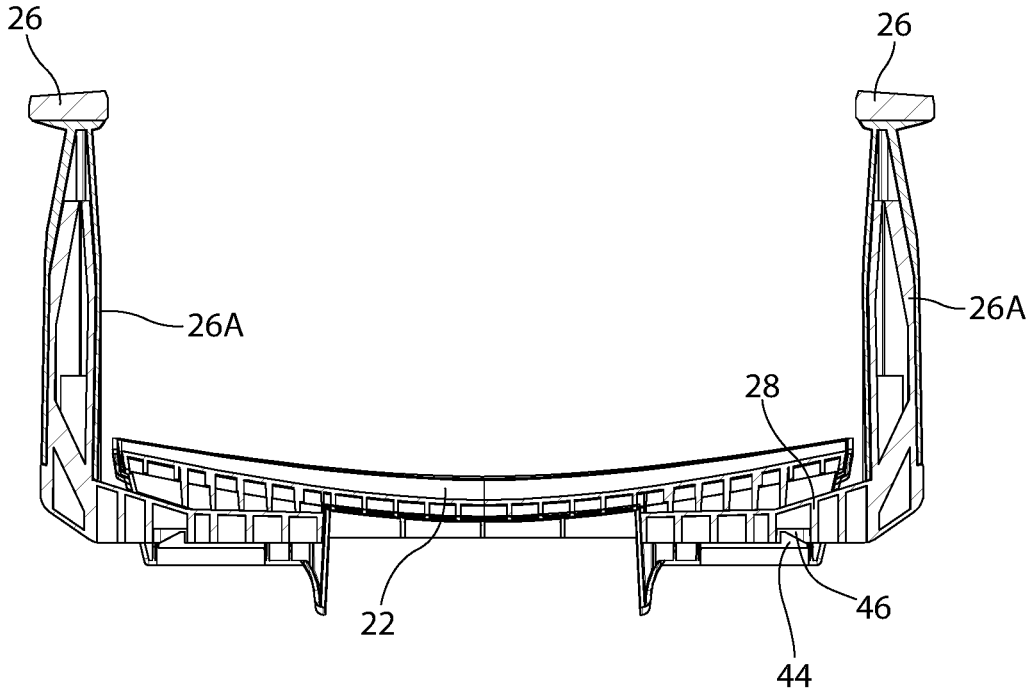
FIG. 6 is a cross-sectional front view of the releasable latch mechanism for the arm rests of the invention.

FIG. 6 shows a cross-sectional side view of the releasable latch mechanism as it is situated within the seat support structure 22. The seat support structure 22 is shown having two arm rests 26 coupled to the seat support structure, wherein each arm rest is supported by an arm rest support 26A, and each arm rest support is coupled to an arm rest connecting member 28. The arm rest connecting member 28 is inserted into a recess 40, which is most visible in FIG. 4A. In this view, the recess 40 (FIG. 4A) is completely filled by the arm rest connecting member 28, and the latch member 44 is in place within the cavity 46 of the arm rest connecting member, securing the arm rest connecting member in place.

Figure 7:
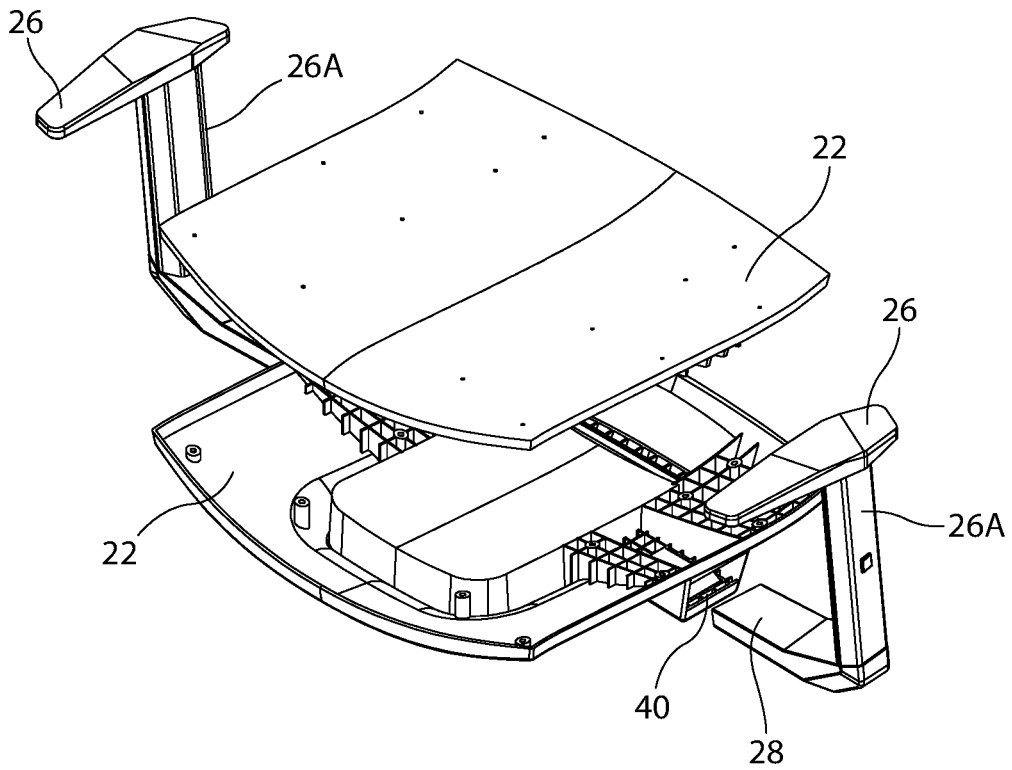
FIG. 7 is an exploded isometric view of an exemplary seat support structure and arm rests of the invention.

FIG. 7 shows an exploded isometric view of an exemplary seat support structure 22 and arm rests 26 of the invention. In this view, the seat support structure 22 is exploded to show one of the recesses 40 inside the seat support structure 22. Each arm rest 26 additionally includes an arm rest support 26A and an arm rest connecting member 28, wherein the arm rest connecting member is received into each recess 40 within the seat support structure 22.

Figure 8:
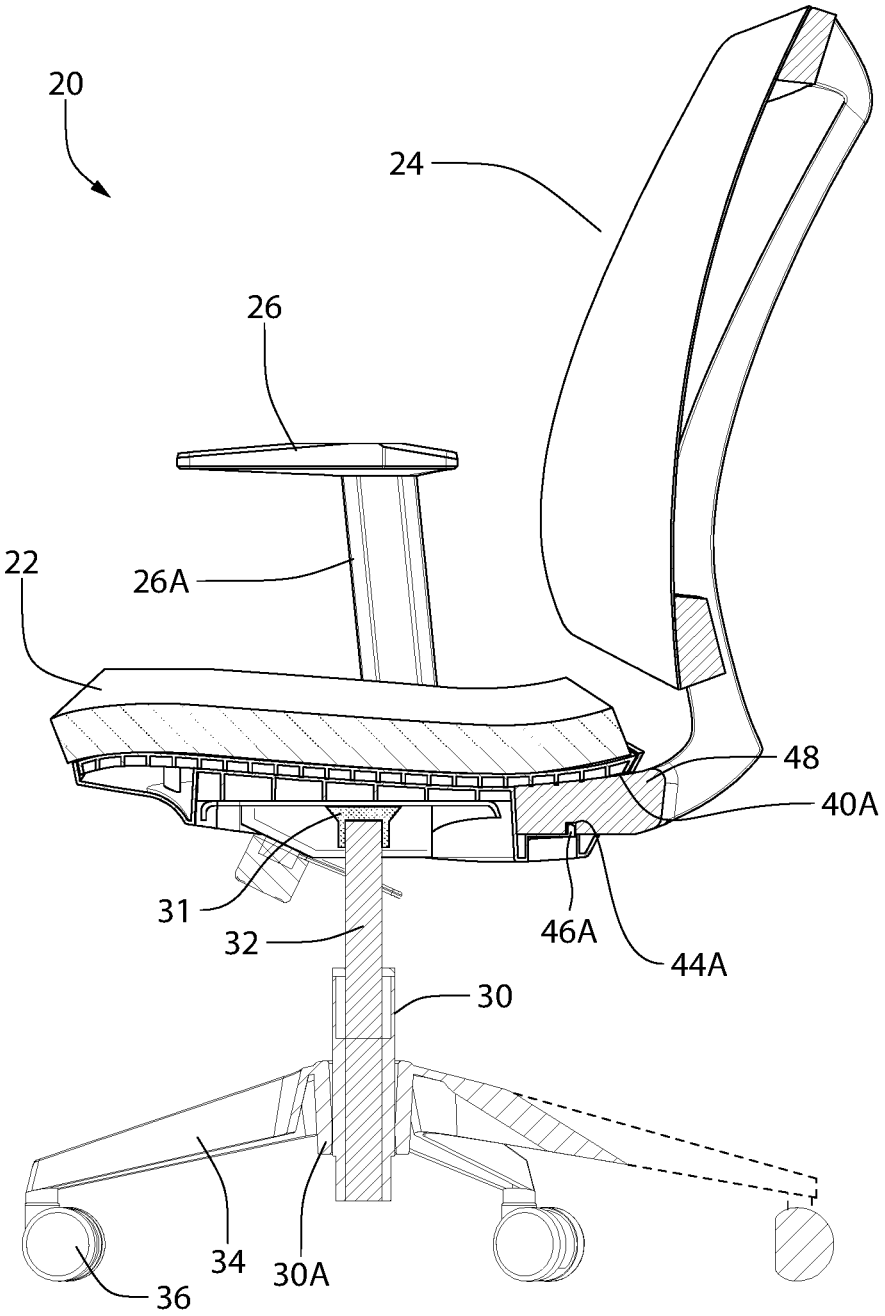
FIG. 8 is a cross-sectional side view of the apparatus wherein the releasable latch mechanism of the back support is shown.

FIG. 8 is a cross-sectional side view of the apparatus 20 wherein the releasable latch mechanism of the back support 24 is shown. In this exemplary embodiment, the apparatus 20 includes a back support 24 which further includes a back support connecting member 48. The back support connecting member 48 includes a cavity 46A. The back support connecting member 48 is received into a recess 40A within the seat support structure 22. When the back support connecting member 48 is fully inserted into the recess 40A, a latch member 44A within the recess 40A slides into the cavity 46A of the back support connecting member 48. As with the examples of the arm rest connecting member 28 (FIGS. 4A-4C) of the invention, the latch member 44A used with the recess 40A is designed to receive the back support connecting member 48 includes an angled design permitting the back support connecting member to glide over the releasable latch mechanism upon insertion until pressure upon the latch member 44A is relieved and the latch member 44A slides into the cavity 46A. Because the latch member 44 is not angled on both sides, however, the latch member 44A cannot unintentionally slip out of the cavity 46A unless the user exerts force to remove it, permitting the back support connecting member 48 to securely couple the back support 24 to the seat support structure 22. As previously stated, each arm rest 26 employs a similar latch member 44 (FIG. 4C).

As stated previously, if it becomes necessary to replace the back support 24, the user can simply a downward pressure to the latch member 44A to displace it out of the cavity 46A to release the back support connecting member 48 and thereby remove the member 48 from the recess 40A.

Additionally shown in the side cross sectional view of the apparatus 20 is the vertical seat shaft 32 which is received on its proximal end into a seat receptacle 31 and a pedestal receptacle 30, wherein the pedestal receptacle 30 is part of a pedestal 34. The pedestal receptacle 30 extends through the center of the pedestal 34 via a pedestal receptacle passage 30A. The vertical seat shaft 32 fits into both the seat receptacle 31 and pedestal receptacle 30 with friction fit, so as the vertical seat shaft 32 fits into both receptacles without space between the vertical seat shaft 32 and the receptacles 30 and 31. As shown, the pedestal receptacle 30 extends below the pedestal in certain examples, permitting the vertical seat shaft 32 to extend and retract into the pedestal receptacle 30 for examples of the apparatus 20 wherein the user is able to adjust the height of the chair. In this example, the pedestal 34 further includes wheels 36 to enable easy movement of the chair.

Figure 9:
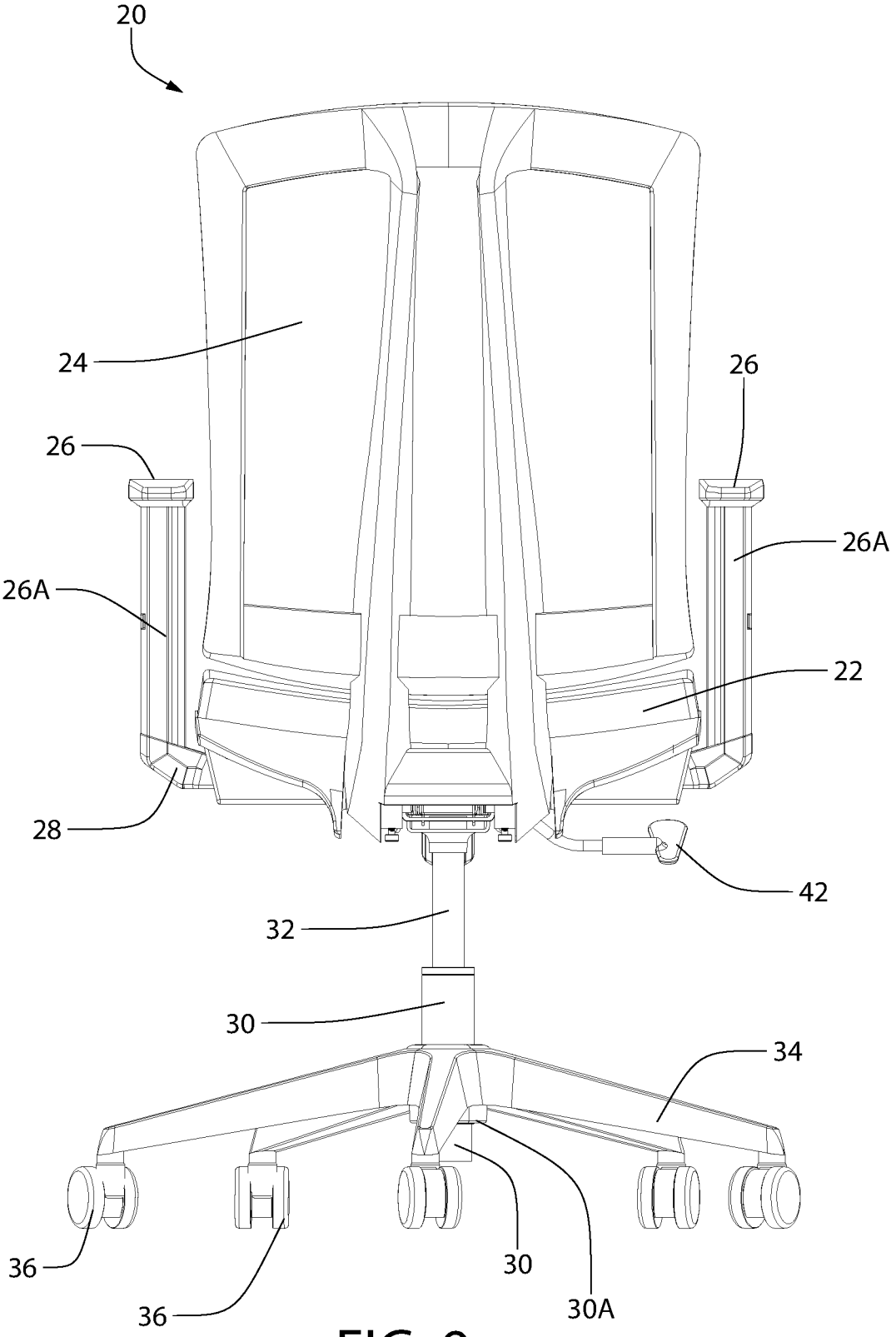
FIG. 9 is a rear view of the apparatus of the invention.

FIG. 9 shows a back view of the chair apparatus 20 of the invention. The back support 24 is shown coupled to the seat support structure 22. The back support is coupled to the seat support structure using the back support connecting member 48 and recess 40A system shown in FIG. 8. The arm rests 26, which each include an arm rest support 26A and arm rest connecting member 28, insert into a recess 40 (FIGS. 4A-4C) within the seat support structure 22 to couple the arm rests to the seat support structure. The example further includes a lever 42, wherein the lever aids in adjustment of the vertical seat shaft 32 when the lever is activated and weight is either added to or removed from the chair. When the lever 42 is released, the vertical seat shaft 32 will lock in place at the desired height. When the height of the chair is decreased, the vertical seat shaft 32 may descend into a pedestal receptacle 30 within the pedestal 34. In certain examples, the extension of the vertical seat shaft 32 is assisted by a lift mechanism. In certain examples, the lift mechanism is a gas lift cylinder. The pedestal receptacle 30 also serves as an attachment point to couple the vertical seat shat 32 to the pedestal 34 via a friction fit. The pedestal receptacle 30 extends through the pedestal 34 via the pedestal receptacle passage 30A. In this example, the pedestal 34 further includes wheels 36.

Figure 10:
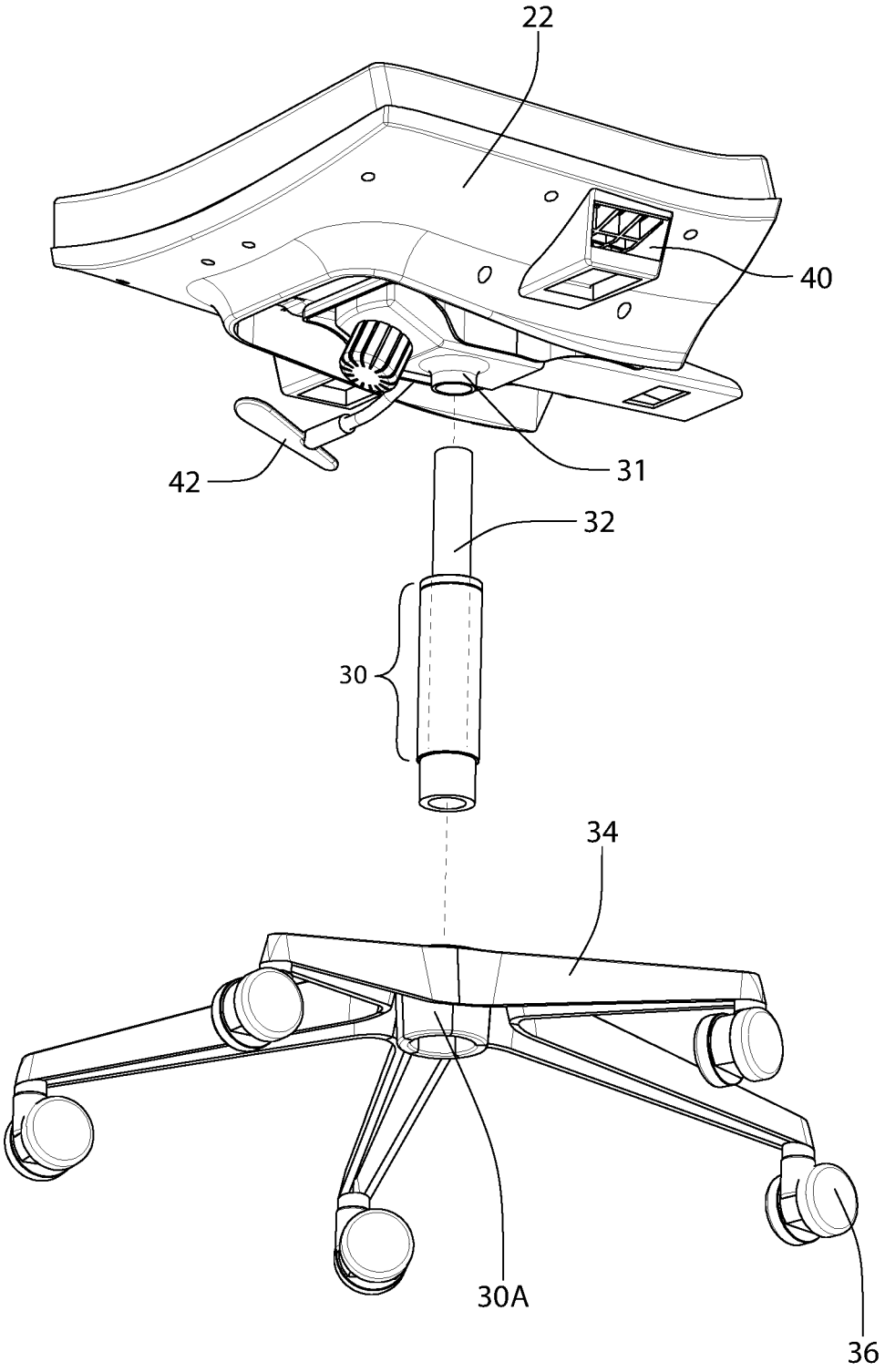
FIG. 10 is an exploded isometric view showing the exemplary coupling of a seat support structure, vertical seat shaft, and pedestal of the invention.

FIG. 10 is an exploded isometric view showing the exemplary coupling of a seat support 22, vertical seat shaft 32, and pedestal 34 of the invention. The seat receptacle 31 is coupled to the underside of the seat support structure 22. In certain examples, the seat support structure 22 additionally houses the lever 42. The vertical seat shaft 32 is received into the seat receptacle 31 on its proximal end and the pedestal receptacle 30 on its distal end. The pedestal receptacle 30 sits within a pedestal receptacle passage 30A within the center of the pedestal 34. In certain examples wherein the height of the chair is adjustable, the vertical seat shaft 32 employs a lift mechanism. In certain nonlimiting examples, the lift mechanism is a gas lift cylinder. The lift mechanism engages when a user pulls upon the lever 42, increasing or decreasing the height of the chair by increasing or decreasing the height of the vertical seat shaft 32.

Figure 11A:
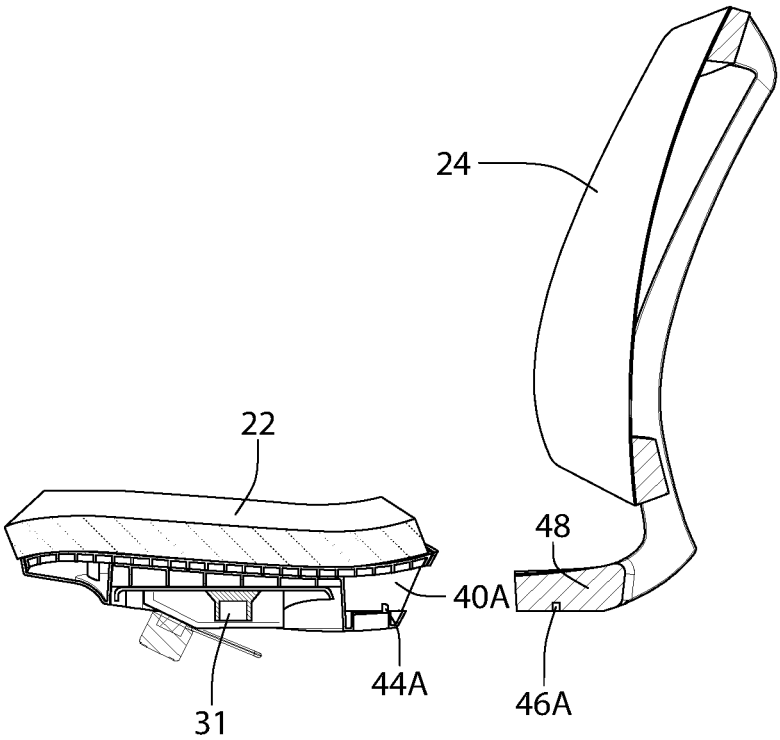
FIG. 11A shows a cross-sectional side view of an exemplary releasable latch mechanism for the back support when the back support connecting member is uncoupled from the seat support structure.

FIG. 11A shows a cross-sectional side view of an exemplary releasable latch mechanism for the back support when the back support connecting member is uncoupled from the seat support structure. In this view, the back support 24 is shown coupled to the back support connecting member 48. The back support connecting member 48 further includes a cavity 46A. The seat support structure 22 further includes a recess 40A, wherein the recess further includes a latch member 44A. In this cross-sectional view, the seat receptacle 31 is also shown. In certain embodiments, the seat receptacle 31 is coupled to the underside of the seat support structure 22. In other examples, the seat receptacle 31 is coupled to another structural unit coupled to the underside of the seat support structure 22.

Figure 11B:
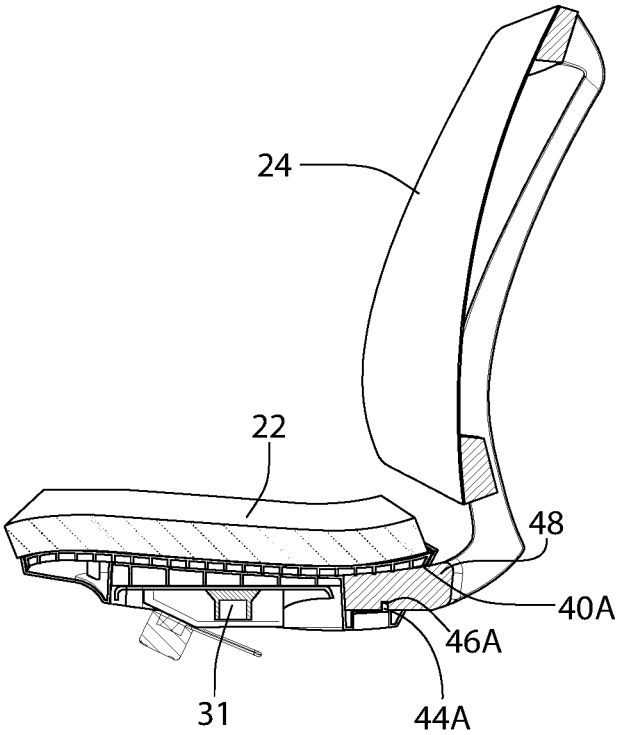
FIG. 11B shows a cross-sectional side view of an exemplary releasable latch mechanism for the back support when the back support connecting member is coupled to the seat support structure.

FIG. 11B shows a cross-sectional side view of an exemplary releasable latch mechanism for the back support 24 when the back support connecting member 48 is coupled to the seat support structure 22. This view again shows the back support 24 coupled to the seat support structure 22 using the system including the back support connecting member 48 including a cavity 46A and recess 40A including a latch member 44A. The user inserts the back support connecting member into a recess 40A within the seat support structure 22, wherein the recess 40A designed to receive the back support connecting member 48 further includes a latch member 44A. When the back support connecting member 48 is fully inserted into the recess 40A, the latch member 44A slides into the cavity 46A, securing the back support 24 to the seat support structure 22 without the use of fasteners. Additionally, the seat receptacle 31 and lever 42 are shown.

Figure 12A:
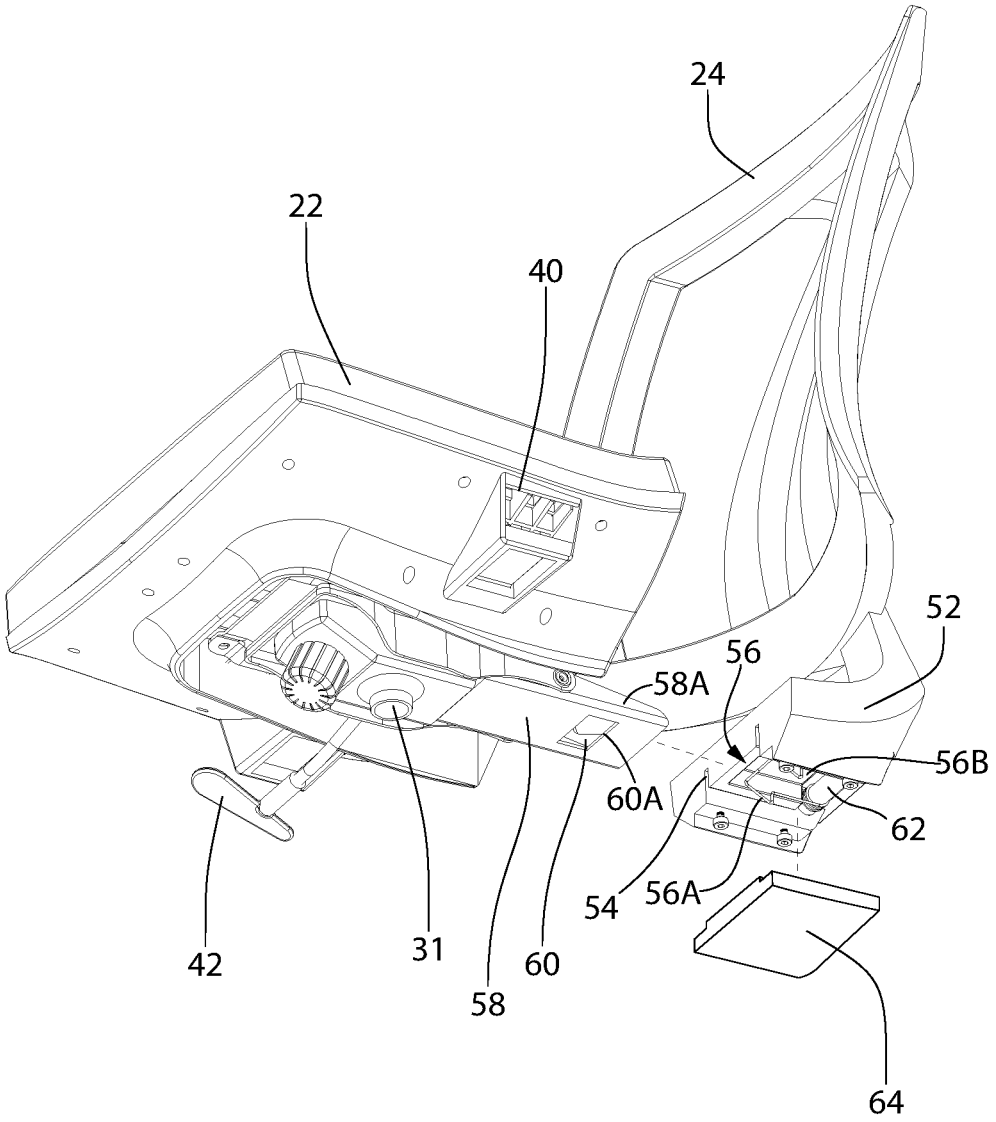
FIG. 12A shows an isometric view of the underside of an exemplary releasable latch mechanism for a reclining back support of the apparatus.

FIG. 12A shows an isometric view of the underside of an exemplary releasable latch mechanism 56 for a reclining back support 24 of the apparatus, rather than a fixed back support discussed previously. In this example, the back support 24 is coupled to the seat support structure 22 via a recess and releasable latch mechanism, wherein the back support 24 is coupled to a reclining back support connecting member 52. The reclining back support connecting member 52 includes a right-angled U-shaped recess 54, wherein the right-angled U-shaped recess 54 forms a chamber 54A (FIG. 12B) which includes a latch spring 56 therein, preferably a double torsion spring. As can be seen most clearly in FIG. 12B, the two sides of the double torsion spring 56 comprise leg formations 56A and 56B that are configured to lodge against one edge 60A of a seat connecting member cavity 60 (FIG. 12C) when latched, as discussed below.

The reclining back support connecting member 52 also includes a pivot point 62, wherein the pivot point 62 permits the back support 24 to recline and is connected to the latch spring 56. In this example, the reclining back support connecting member 52 includes a cover 64 (shown exploded away for clarity only in FIG. 12A) which forms the bottom portion of the right-angled U-shaped recess 54 when installed. The right-angled U-shaped recess 54 provides an enclosed recess for a seat connecting member 58 to be inserted into. In particular, the forward end 58A of the seat connecting member has a corresponding right-angled U-shaped form that is configured to pass into the right-angled U-shaped recess 54. It should be understood that the cover 64 is shown exploded away from the reclining back support connecting member 52 in FIGS. 12A-12B for clarity only and to clearly depict the latch spring 56 operation, the chamber 54A (formed by the right-angled U-shaped recess 54 and the cover 64) and to clearly depict the pivot point 62. In normal use, the cover 64 is secured to the member 52, thereby forming the complete right-angled U-shaped recess 54/chamber 54A for receiving the seat connecting member 58. The seat connecting member 58 is coupled to the seat support structure 22. The seat connecting member 58 further includes a seat connecting member cavity 60. In this view of the underside of the seat support structure, the recess 40 designed to receive the arm rests connecting member 28 is shown, and the arm rest connecting member 28 couples to the seat support structure 22 in the same fashion as described in FIGS. 4A-4C. The seat receptacle 31 is also shown with the lever 42.

Figure 12B:
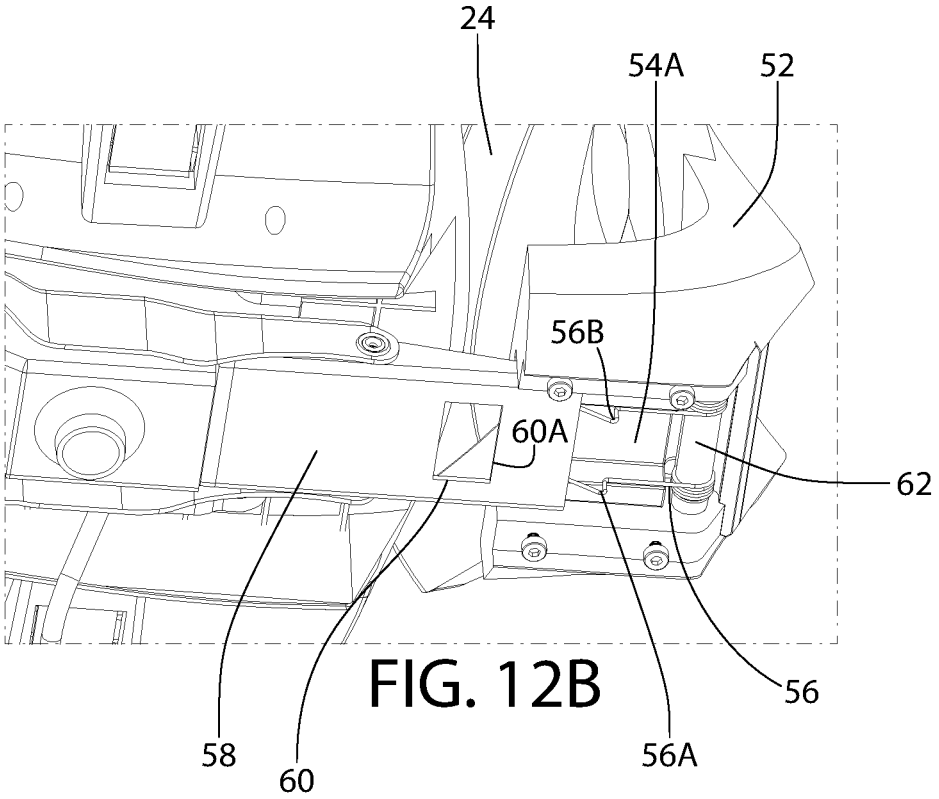
FIG. 12B is a partially-exploded view showing an exemplary releasable latch mechanism for an apparatus including a reclining back support when the seat connecting member is partially inserted into a right-angled U-shaped recess.

FIG. 12B shows the exemplary releasable latch mechanism for the apparatus which includes the reclining back support 24 when the seat connecting member 58 is partially inserted into the right-angled U-shaped recess 54. In this example, the reclining back support connecting member 52 is shown coupled to the back support 24. The reclining back support connecting member 52 includes the right-angled U-shaped recess 54, wherein the right-angled U-shaped recess 54 further includes a latch spring 56. The reclining back support connecting member 52 also includes a pivot point 62, wherein the pivot point 62 permits the chair to recline and include and is connected to the latch spring 56.

A close-up of the seat connecting member 58 is shown, wherein the seat connecting member 58 slides into the right-angled-U-shaped recess 54. When this occurs, the latch spring 56 slides into the seat connecting member cavity 60 (FIG. 12A), securing the seat connecting member 58 in place, and thus removably coupling the seat support structure 22 (FIG. 12A) to the back support 24.

Figure 12C:
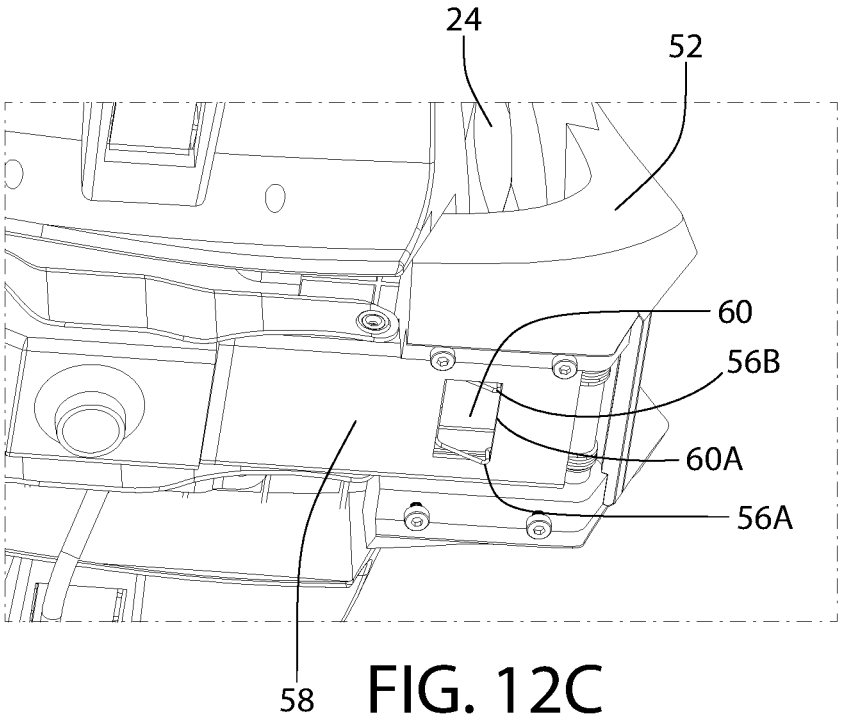
FIG. 12C shows an exemplary releasable latch mechanism for the apparatus including the reclining back support when the seat connecting member is fully inserted into the right-angled U-shaped recess.

FIG. 12C shows the exemplary releasable latch mechanism for the apparatus including the reclining back support when the seat connecting member 58 is fully inserted into the right-angled U-shaped recess 54. The same mechanism as described in FIG. 12B is shown, including the reclining back support connecting member 52 further including the right-angled U-shaped recess 54 to receive the seat connecting member 58 therein. The right-angled U-shaped recess 54 further includes the double torsion spring 56. In this view, with the leg formations 56A/56B lodged against the edge 60A of the connecting member cavity 60, the reclining back support 24 is releasably secured to the seat support structure 22 (FIG. 12A). Conversely, to disengage the reclining back support 24 to either disassemble the chair or change out the back support 24 for a different model of compatible modular back support, the user can apply an upward force on the latch spring 56 to release the leg formations 56A/56B of the latch spring 56 from the cavity 60, permitting the seat connecting member 58 to slide out of the right-angled-U-shaped recess 54. Upward force may be applied by the user's hand, or by a narrow object capable of reaching the latch spring 56.

While the invention has been described in detail and with reference to specific examples thereof, it will be apparent to one skilled in the art that various changes and modifications can be made therein without departing from the spirit and scope thereof.

REFERENCES

[1] Office and administrative support occupations make up nearly 16 percent of U.S. employment, May 2013, U.S. BUREAU OF LABOR STATISTICS (Apr. 9, 2014), https://www.bls.gov/opub/ted/2014/ted_20140409.htm.

What is claimed is:

1. A method for assembling a modular chair wherein said modular chair includes a pedestal into which one end of a vertical seat shaft is fitted, a seat support structure, wherein the seat support structure includes a plurality of recesses along its sides and includes a vertical seat shaft receptacle on a bottom side for receiving a second end of said vertical seat shaft, and wherein each recess includes a releasable latch mechanism; a first arm rest and a second arm rest, wherein each arm rest includes an arm rest connecting member having a cavity therein, each cavity receiving therein a latch member of said releasable latch mechanism of a corresponding one of said plurality of recesses when said arm rest connecting member is inserted into said corresponding one of said plurality of recesses; and a back support, wherein said back support includes a back support connecting member also having a cavity therein, said cavity of said back support connecting member receiving therein a latch member of said releasable latch mechanism of another one of said plurality of recesses, said method comprising:

(a) releasably coupling one end of said vertical seat shaft into said pedestal and coupling said second end of said vertical seat shaft with said receptacle;

(b) releasably coupling said first and second arm rests to said seat support structure by inserting said arm rest connecting members of said first arm rest and said second arm rest into corresponding ones of said plurality of recesses;

(c) releasably coupling said back support to said seat support structure by inserting said back support connecting member within said another one of said plurality of recesses; and conducting steps (a)-(c) without using any fasteners.

2. A modular chair having components that can be assembled without the use of fasteners, said modular chair comprising:

(a) a pedestal into which one end of a vertical seat shaft is fitted;

(b) a seat support structure, wherein the seat support structure includes:

(c) a plurality of recesses along its sides and wherein each recess includes a releasable latch mechanism;

(d) a seat connecting member projecting from said seat support along a side that does not include a recess, said seat connecting member comprising a cavity therein;

(e) a vertical seat shaft receptacle on a bottom side of said seat support for receiving a second end of said vertical seat shaft;

(f) a first arm rest and a second arm rest, wherein each arm rest includes an arm rest connecting member having a cavity therein, each cavity receiving therein a latch member of said releasable latch mechanism of a corresponding one of said plurality of recesses when said arm rest connecting member is inserted into said corresponding one of said plurality of recesses; and (g) a reclining back support having a lower portion having a chamber with a latch spring positioned therein, said seat connecting member configured for entry into said chamber causing a portion of said latch spring to releasably engage within said cavity of said seat connecting member to connect said reclining back support to said modular chair.

3. The modular chair of claim 2 wherein said latch spring is a double torsion spring.

4. The modular chair of claim 2 wherein said one end of said second end of said vertical shaft forms a friction fit within said receptacle.

5. The modular chair of claim 2 wherein said seat support structure further includes a lever which permits a user to adjust the height of the seat support structure.

6. The modular chair of claim 2 wherein the pedestal further includes a plurality of wheels.

7. The modular chair of claim 2 wherein said pedestal includes a pedestal receptacle and wherein said one end of said vertical seat shaft is friction fitted within said pedestal receptacle.

8. The modular chair of claim 2 wherein said back support further comprises a head support.

9. The modular chair of claim 2 wherein said back support comprises a flexible mesh material.

10. The modular chair of claim 2 wherein said back support is shaped to follow a natural curvature of the human spine.

11. A method for assembling a modular chair wherein said modular chair includes a pedestal into which one end of a vertical seat shaft is fitted, a seat support structure, wherein the seat support structure includes a plurality of recesses along its sides and includes a vertical seat shaft receptacle on a bottom side for receiving a second end of said vertical seat shaft, and wherein each recess includes a releasable latch mechanism; a first arm rest and a second arm rest, wherein each arm rest includes an arm rest connecting member having a cavity therein, each cavity receiving therein a latch member of said releasable latch mechanism of a corresponding one of said plurality of recesses when said arm rest connecting member is inserted into said corresponding one of said plurality of recesses; and a reclining back support having a lower portion having a chamber with a latch spring positioned therein, and wherein said seat connecting member is configured for entry into said chamber causing a portion of said latch spring to releasably engage within said cavity of said seat connecting member to connect said reclining back support to said modular chair, said method comprising:

(a) releasably coupling one end of said vertical seat shaft into said pedestal and coupling said second end of said vertical seat shaft with said receptacle;

(b) releasably coupling said first and second arm rests to said seat support structure by inserting said arm rest connecting members of said first arm rest and said second arm rest into corresponding ones of said plurality of recesses;

(c) releasably coupling said reclining back support to said seat support structure by inserting said seat connecting member within said chamber having said latch spring therein, said latch spring comprising portions that lodge against a wall of said cavity of said seat connecting member to releasably couple said reclining back support to said seat support structure; and conducting steps (a)-(c) without using any fasteners.

* * * * *